US005259255A

United States Patent [19]

Urban et al.

[11] Patent Number: 5,259,255

[45] Date of Patent: * Nov. 9, 1993

[54] APPARATUS FOR POSITIONING DEVICES FOR OPERATING UPON SHEETS OR WEBS

[75] Inventors: Ernst-Günther Urban; Heiko-Christian Knoll, both of Neuss, Fed. Rep. of Germany

[73] Assignee: Jagenberg Aktiengesellschaft, Dusseldorf, Fed. Rep. of Germany

[ * ] Notice: The portion of the term of this patent subsequent to Dec. 17, 2008 has been disclaimed.

[21] Appl. No.: 740,105

[22] Filed: Aug. 5, 1991

Related U.S. Application Data

[62] Division of Ser. No. 589,087, Sep. 27, 1990, Pat. No. 5,072,641.

[30] Foreign Application Priority Data

Nov. 17, 1989 [DE] Fed. Rep. of Germany ..... 3938278

[51] Int. Cl.[5] ..... B26D 1/24

[52] U.S. Cl. ..... 74/37; 74/89.22; 83/499; 83/508.3; 198/750

[58] Field of Search ..... 83/498, 499, 504, 507, 83/508.3, 428; 198/468.9, 750; 74/37, 89.22

[56] References Cited

U.S. PATENT DOCUMENTS

| | | | |
|---|---|---|---|
| 479,297 | 7/1892 | McCarthy | 74/37 X |
| 1,705,545 | 3/1929 | Seward | 74/37 |
| 2,939,321 | 6/1960 | Shovic | 74/37 X |
| 3,470,776 | 10/1969 | Brichard et al. | 83/700 X |
| 3,786,705 | 1/1974 | Dorfel | 83/428 X |
| 4,198,170 | 4/1980 | Decker | 74/37 X |
| 4,934,234 | 6/1990 | Cavagna | 83/498 |
| 4,989,486 | 2/1991 | Miller et al. | 83/499 |
| 5,072,641 | 12/1991 | Urban et al. | 83/504 X |
| 5,097,732 | 3/1992 | Tahara | 83/499 X |

FOREIGN PATENT DOCUMENTS

| | | |
|---|---|---|
| 0347060 | 9/1989 | European Pat. Off. . |
| 3426302 | 7/1984 | Fed. Rep. of Germany . |
| 2072563 | 3/1981 | United Kingdom . |

*Primary Examiner*—Douglas D. Watts
*Assistant Examiner*—Kenneth E. Peterson
*Attorney, Agent, or Firm*—Herbert Dubno

[57] ABSTRACT

An apparatus for positioning devices, especially longitudinal rotary cutting blades for slitting a web of material has slides displaceable along respective guides and a belt which has oppositely moving stretches as the belt is moved in a single sense. A coupling, e.g. a double-acting piston, between the belt stretches and the slide can be actuated to press against one or the other stretch or pass of the belt to couple it with the slide. The coupling also has a cylinder-and-piston for clamping the slide against its guide to lock the slide in position when the proper position is reached.

1 Claim, 3 Drawing Sheets

APPARATUS FOR POSITIONING DEVICES FOR OPERATING UPON SHEETS OR WEBS

This is a divisional of co-pending application Ser. No. 07/589,087 filed on Sep. 27, 1990, now U.S. Pat. No. 5,072,641.

FIELD OF THE INVENTION

Our present invention relates to an apparatus for positioning a device, such as a tool, for operating upon a band, strip, web or sheet of material, e.g. a paper sheet, a plastic foil, a fabric or the like.

BACKGROUND OF THE INVENTION

In the processing of sheet materials, i.e. webs, bands, individual sheets or piece goods, the material frequently requires processing by a tool or other device which must be accurately positioned relative to the path of the web. Typical of such processing is the slitting of a continuous web utilizing blades which must be accurately positioned transversely of the web travel direction. Other processing devices likewise may have to be accurately positioned in a web processing apparatus relative to the web travel direction or in the web travel direction.

The specific case of a machine for this purpose is the machine which may be required for cutting or other processing of paper or cardboard webs and which may have a number of elements or devices which must be accurately positioned in accordance with the format or size of the sheets to be processed or produced.

Pairs of circular blades, for example, may be used to cut such a web and must be accurately positioned relative to one another and with respect to the format of the product to be made. Such blades are typical of the devices which are to be accurately positioned by the apparatus of the present invention and serve to subdivide the web into individual webs by longitudinally slitting or even for subdividing webs into sheets or pieces.

In the case in which a relatively wide web of material must be longitudinally slit into a number of narrower webs continuously, the cutting devices must be accurately positioned transversely of the web travel direction.

In German patent document DE-AS 21 42 117, a cutting apparatus for this purpose is described in which the pairs of circular blades are carried on respective slides displaceable on guides, e.g. rails, transverse to the web travel direction by respective endless belts which can be driven by electric motors and to which the slides are respectively clamped. The belt is constituted as the drive element. Each blade slide is provided, therefore, with an arresting member having two positions. In one position the member brings about engagement with a stretch of the belt and in another position, the member brings about engagement with the guide to lock the guide in place. The arresting member can be a double-acting piston.

In this system, the slides can only be coupled to one stretch or pass of the respective belt so that, for reversal of the movement of the slide, the drive of the belt must be reversed. This requires a complex and expensive control system for the belt drive and increases the time required for changeover or the position of the blades in a multislide system since it is not possible to simultaneously adjust the positions of all of the slides of a key belt if the blade carts or slides are required to be moved in opposite directions for this adjustment.

OBJECTS OF THE INVENTION

It is the principal object of the present invention to provide an improved apparatus for positioning a device, particularly in the applications mentioned above whereby the drawbacks of the earlier system are avoided and the simultaneous positioning of a multiplicity of slides utilizing a common belt and in different directions is made possible.

Another object of the invention is to provide an improved apparatus for positioning a device for operating upon webs of material, particularly for slitting webs, which is of simple construction, is reliable and is free from complex equipment necessary for switching over belt direction.

SUMMARY OF THE INVENTION

These objects and others which will become apparent hereinafter are attained, in accordance with the invention in an apparatus for positioning a device for operating upon a flat workpiece, comprising:

a substantially rectilinear guide for the device;

a slide carrying the device and shiftable along the guide;

an endless belt having two oppositely moving longitudinal stretches parallel to the guide; and coupling means on the slide disposed between the longitudinal stretches and having respective elements selectively and alternatively engageable with the stretches to couple the slide to the stretches selectively for movement in the direction of a respective one of the stretches along the guide.

According to the invention, therefore, the individual slides spaced along the belt can have a relative coupling means engage either of the stretches of the belt selectively for adjustment in either direction along the belt while the belt is driven continuously and only in one sense, since the stretches of the belt move in opposite direction.

Because of the possibility that each slide can be selectively coupled to one or the other stretch, the adjustment is effected in either direction without the change in belt direction. Furthermore, since the belt direction does not have to change, two or more slides on a common guide can be moved in opposite directions by one and the same belt, thereby minimizing the overall adjustment time for the apparatus.

According to a feature of the invention, the respective elements selectively and alternatively engageable with the stretches of the belt are respective piston ends of a double-acting piston-and-cylinder unit. The stretches are guided along respective surfaces of the slide and the piston ends respectively and selectively can clamp the respective stretches against the respective surfaces.

To arrest the slide in the working position, the present invention provides the coupling means with a further piston displaceable in a cylinder perpendicular to the double-acting piston-and-cylinder and defining a pressurizable compartment, separate from those defined by the double-acting piston. The pistons of the arresting means and the coupling means can be actuated by pneumatic pressure.

In general, when the device is a rotary cutting blade for slitting a longitudinal web, two such blades cooperate in a shearing action and the two blades are carried by respective slides on respective guides and are adjustable via respective belts and coupling means as described.

In one embodiment of the invention, both of the slides are provided with position-indicating means, e.g. angular pulse generators which output pulses in pulse trains which represent the position of the slider. This ensures precise monitoring and positioning of the two cooperating sliders.

It is also possible, in accordance with the invention, to provide only one of the sliders with an absolute position-measuring unit for measuring displacement along the respective slide while the other of the slides is coupled with the first-mentioned slide by a proximity sensor responsive to the position of that slide.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
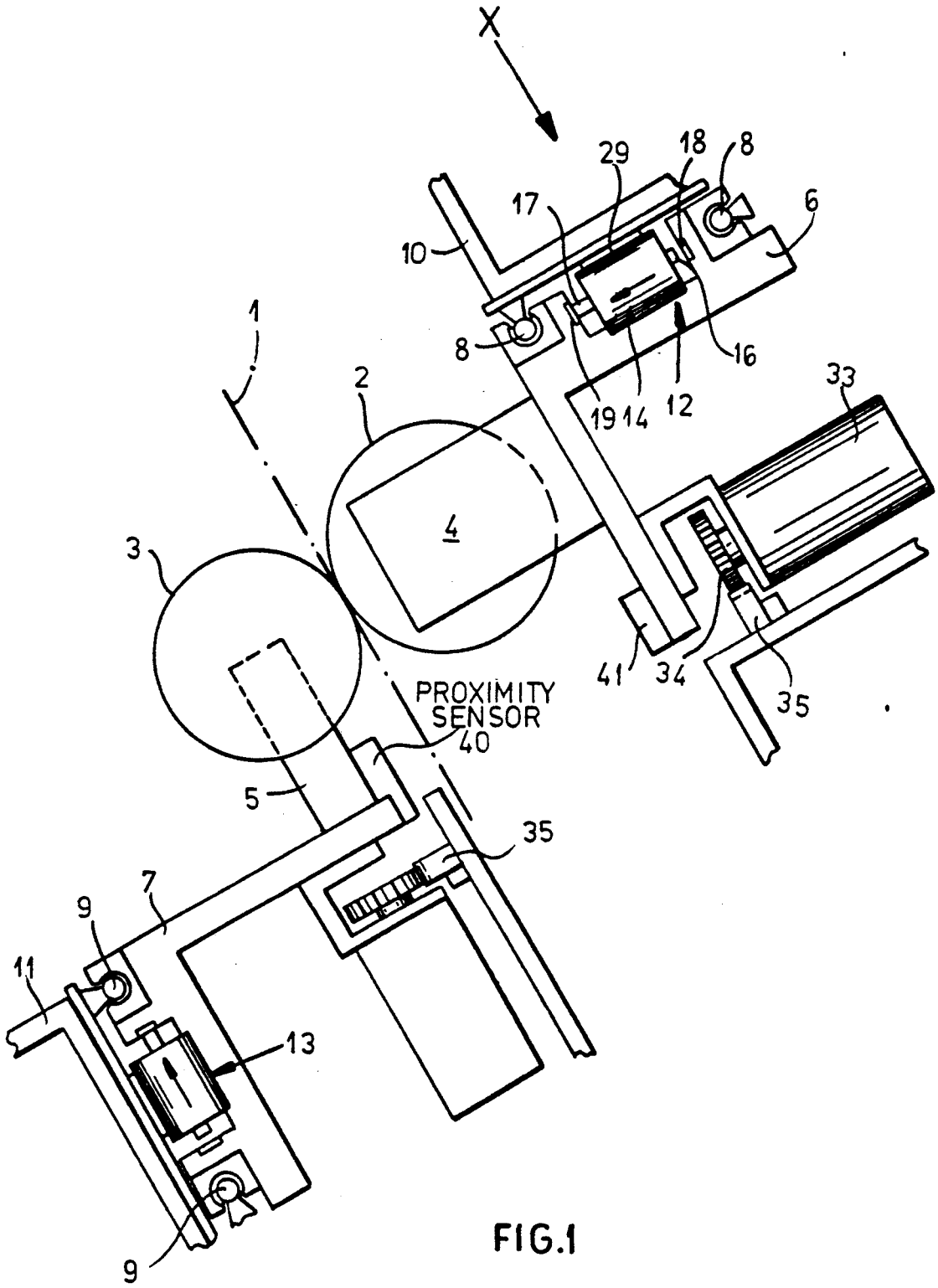
FIG. 1 is a schematic view of the apparatus of the invention as seen from a side and oriented to conventionally fit upon the page, normally the web being horizontal with the device on the right-hand side thereof in FIG. 1 being located below the web.

The apparatus illustrated in the drawing will be described in connection with a device for positioning the circular blades of a longitudinal web-slitting apparatus. The paired circular blades can be used to subdivide a web of material, for example a paper or cardboard web, into narrower webs which can then be wound up by a coiler in rolls. The apparatus can also be used for transverse cutting of the web into individual sheets.

Other applications for the apparatus of the invention in the processing of web or sheet material include the positioning of the coiling stations of the coiling machine, the positioning of the transverse format-determining elements of cutting machines and stacking machines, the plates used for vibrating sheets into stacks and transport elements for stackers and the like.

The longitudinal slitting apparatus shown in FIG. 1 comprises a plurality of circular blade pairs which can be shiftable transversely to the longitudinal dimension of the web 1 of material to be slit and each pair of which can comprise a lower blade 2 and an upper blade 3.

The lower blade 2 and the upper blade 3 are each mounted by a respective bracket 4 or 5 on a slide or blade carriage 6 or 7 to enable the blades to rotate as is customary in this type of apparatus.

The slides 6 and 7 are displaceable along rod-like or similar guides 8 or 9 supported on transverse angles 10, 11 or the like forming part of the machine frame or structure.

Figure 3:
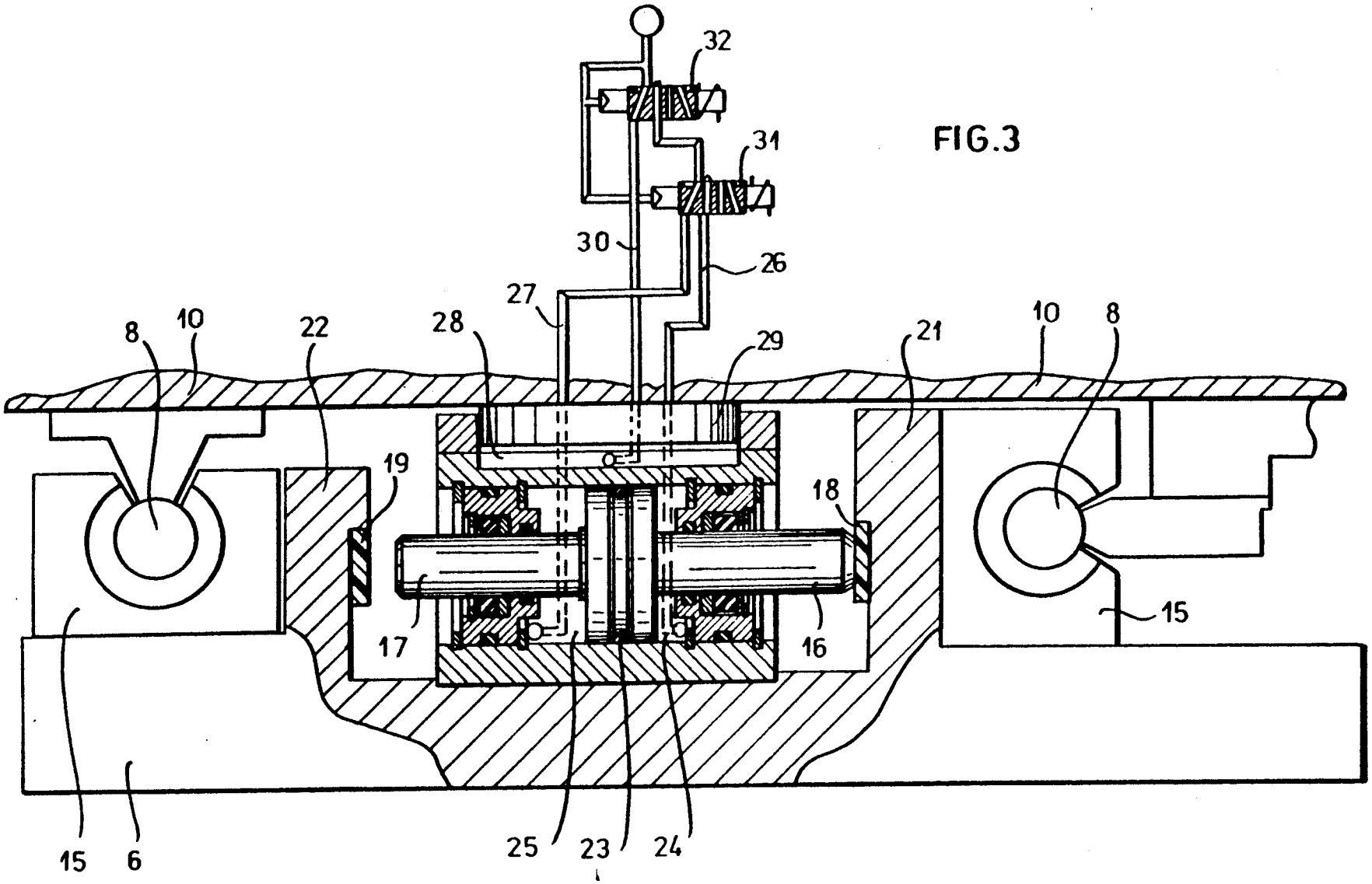
FIG. 3 is an enlarged illustration of a partial section of the apparatus of FIG. 1.

To position the blade slides 6 and 7, adjusting devices 12 and 13 are provided, the construction of which is better illustrated in FIG. 3 in an enlarged view for the adjusting device 122 of the lower blade. The adjusting device 13 of the upper blade is of corresponding construction.

The adjusting device 12 includes a coupling element formed by a double-acting pneumatic piston-and-cylinder unit whose cylinder 14 is affixed on the slide 6 between the bearings 15 of the guide elements 8.

The two piston ends 16 and 17 are each juxtaposed with one stretch 18 or 19 of an endless belt driven in one direction by a motor 20, the belt extending transversely across the web over the length at least of the adjustment path parallel to the guide element 8.

The two stretches 18 and 19 of the belt are braced by the surfaces formed by projections 21 and 22 at their sides opposite those along which the piston ends 16 and 17 are provided. The projections 21 and 22 can be integral with the slide.

Depending upon the sense in which the double-acting piston is actuated, one of the piston ends 16 or 17 will clamp the respective stretch 18 or 19 against one of the projections 21 or 22 and thereby couple the slide to that stretch of the belt. For this purpose, cylinder compartments 24 and 25, separated by a seal 23, can be pressurized via lines 26 and 27 with compressed air.

On the side of the piston-and-cylinder unit turned toward the traverse 10, a further pressurizable compartment 28 is provided in which a movable clamping piston 29 is provided. When the compartment 28 is pressurized with compressed air via the passage 30, the slide is clamped against the traverse 10 and held in working position along the guide 8.

The valves 31 and 32, which control the movements of the piston 16, 17 and 29 and are operated by a control arrangement not shown, have been illustrated only diagrammatically in FIG. 3. The control arrangement may be a simple set of electrical switches for operating the valves. Alternatively, instead of pneumatically operating, piston-and-cylinder units, electromagnetically actuated pistons can be used to clamp the slide 6 and 7 on the respective stretches 18 and 19 and of belts and to arrest the slides against the traverse 10.

In the embodiment shown, for position determination, the lower slides 6 and the upper slide 7 are each provided with an angle encoder 33 (FIG. 1) generating a train of pulses upon rotation.

The angle encoders 33 have a pinion 34 connected to the signal-generating disk, a meshing with a rack 35 fixed to the respective traverse 10 or 11. The angle encoder 33 generates, upon displacement of the slide 6 or 7 along the traverse 10 or 11, a number of countable pulses which represents the respective displacement and the pulse train can be inputted to control responsive to the slide position starting from a known starting point to enable the double-acting pistons to be disengaged from the belt and the clamping pistons are engaged to lock the slide in place at the appropriate point. Each present position can be thus utilized as the starting point for the angle set-point position.

As represented diagrammatically in FIG. 1, a proximity sensor 40 can be provided to respond, for example, to a magnet 41 of a slide 12 formed with the encoder 33 so that the slider 7 can be positioned to follow the position of the positively positioned slider 6. The proximity sensor 40 can include, for example, a Hall-effect sensor.

Figure 2:
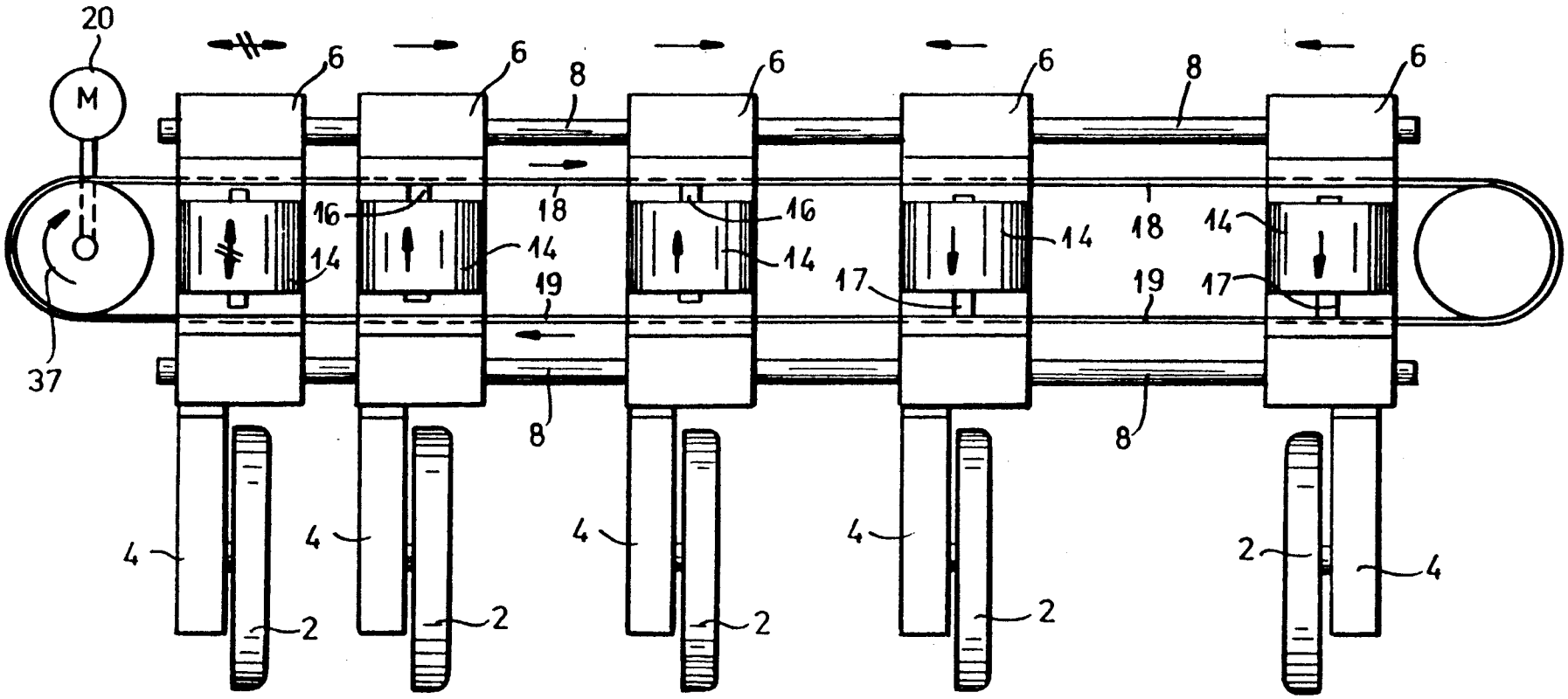
FIG. 2 is a view taken in the direction x of FIG. 1.

For positioning the individual slides 6 and 7, the belts 18 and 19 are driven by the respective motors 20 continuously with uniform speed in a single sense of rotation. In FIG. 2 this has been represented as the clockwise sense by the arrow 37.

As a result, as seen in FIG. 2, the stretch 18 moves to the right and the stretch 19 to the left. In the section of FIG. 3, the stretch 19 moves into the plane of the paper and stretch 18 moves out of the plane of the paper.

In their starting positions during operation of the longitudinal slitting blades, the slides 6 and 7 are clamped against the traverses 10 and 11. Valve 32, for this purpose, supplies compressed air to the compartment 28 to press the respective clamping pistons 29 against the traverse 10 or 11.

Simultaneously the cylinder compartments 24 and 25 are vented so that neither piston 16 nor the piston 17 bears upon the respective stretch 18 or 19 of the belt.

To position the slides 6 and 7 anew, the compartment 28 is first vented to release the clamping engagement of the slides against the traverses 10 and 11.

Simultaneously depending upon the direction in which the slide is to be displaced, either the compartment 24 or the compartment 25 is pressurized while the other compartment is vented.

If compressed air is supplied to the cylinder compartment 25, the piston end 16 is pressed against the belt stretch 18 and thus couples it with the slide 6. The slide 6 is then moved to the right in FIG. 2. Analogously, should the slide 6 have to be moved to the left, cylinder compartment 24 is pressurized to couple the slide to the belt stretch 19.

Consequently, without changing the direction of the belt, the slide 6 and 7 can be moved in both directions and it is simultaneously possible to move individual slides along each guide 8, compare FIG. 2, in one direction, while other slides along the same guide and belt are moved in the opposite direction.

We claim:

1. An apparatus for positioning a device for operating upon a flat workpiece, comprising:

a substantially rectilinear guide for said device;

a slide carrying said device and shiftable along said guide;

an endless belt having two oppositely moving longitudinal stretches parallel to said guide;

coupling means on said slide disposed between said longitudinal stretches and having respective elements selectively and alternatively engageable with said stretches to couple said slide to said stretches selectively for movement in the direction of a respective one of said stretches along said guide, said elements being respective piston ends, said coupling means including a double-acting piston and cylinder unit and said piston ends being ends of a single piston of said unit displaceable in opposite directions in a cylinder of said unit to selectively engage one of said stretches, said stretches being guided along respective surfaces of said slide, said ends respectively and selectively clamping the respective stretches against the respective surface;

a single further piston displaceable in a cylinder perpendicular to said double-acting piston directly against a surface of said guide, said cylinder being formed directly in said double-acting piston and cylinder unit and defining therein a pressurizable compartment separate from pressurizable compartments defined by said double-acting piston; and means for actuating said pistons by pneumatic pressure.

* * * * *